United States Patent [19]

Miedema

[11] 4,376,940

[45] Mar. 15, 1983

[54] ANTENNA ARRANGEMENTS FOR SUPPRESSING SELECTED SIDELOBES

[75] Inventor: Hotze Miedema, Boxford, Mass.

[73] Assignee: Bell Telephone Laboratories, Incorporated, Murray Hill, N.J.

[21] Appl. No.: 201,822

[22] Filed: Oct. 29, 1980

[51] Int. Cl.[3] ..... H01Q 3/26

[52] U.S. Cl. ..... 343/840; 343/100 LE; 343/853

[58] Field of Search ..... 343/840, 853, 854, 100 LE

[56] References Cited

U.S. PATENT DOCUMENTS

| | | | |
|---|---|---|---|
| 2,718,592 | 9/1955 | Smith | 343/778 |
| 2,990,544 | 6/1961 | La Rosa | 343/840 |
| 3,094,695 | 6/1963 | Jahn | 343/100 LE |
| 3,140,491 | 7/1964 | Ashbauch et al. | 343/840 |
| 3,160,887 | 12/1964 | Broussaud et al. | 343/777 |
| 3,176,301 | 3/1965 | Wellons et al. | 343/782 |
| 3,202,990 | 8/1965 | Howells | 343/100 LE |
| 3,300,268 | 1/1967 | Straub | 343/840 |
| 3,325,816 | 6/1967 | Dutton | 343/777 |
| 3,633,208 | 1/1972 | Ajioka | 343/778 |
| 3,704,464 | 11/1972 | Drane et al. | 343/100 LE |
| 3,811,129 | 5/1974 | Holst | 343/844 |
| 3,815,140 | 6/1974 | Buehler et al. | 343/779 |

OTHER PUBLICATIONS

Parekh, Reshaped Subreflectors Reduce Antenna Sidelobes; Microwaves, vol. 16, No. 5, pp. 170–173.

*Primary Examiner*—Eli Lieberman

*Attorney, Agent, or Firm*—Erwin W. Pfeifle

[57] ABSTRACT

The present invention relates to wideband antenna arrangements for suppressing selected sidelobes comprising a main antenna (10) comprising a predetermined aperture (l) and two sidelobe suppression means (12, 14, 40, 42) disposed adjacent and on symmetrically opposite sides of the main antenna in the plane of the sidelobes to be suppressed. The distance between the suppression means preferably approximates the width of the aperture of the main antenna and the aperture size of the suppression means controls the sidelobe suppression region at the aperture of the main antenna. The suppression means can comprise two auxiliary antennas or two sections of the main antenna focusing reflector having apertures ($l_1$) which are smaller than that of the main antenna.

8 Claims, 9 Drawing Figures

ANTENNA ARRANGEMENTS FOR SUPPRESSING SELECTED SIDELOBES

BACKGROUND OF THE INVENTION

1. Field of the Invention

The present invention relates to antenna arrangements for suppressing selected sidelobes and, more particularly, to antenna arrangements comprising a main antenna including a main reflector and a feedhorn, and sidelobe suppressing means comprising either (a) at least two auxiliary antennas each including a reflector having a predetermined aperture and a feedhorn for launching the same signal, with a proper level and phase, as the main antenna, the auxiliary antennas being disposed on opposite sides of the main antenna with spacings that approximately equal the edges of the aperture of the main antenna in the plane of the sidelobes to be suppressed, or (b) sections of the reflective surface of the main reflector of the main antenna which are displaced by a predetermined amount in a direction parallel to the boresight axis of the main antenna in the plane of the sidelobes to be suppressed.

2. Description of the Prior Art

In radar systems and in terrestrial and satellite communication systems, various techniques have been used to reduce certain sidelobes and in turn the interference therefrom in adjacent links. In receiving systems, undesired sidelobe signals are generally suppressed by receiving the desired signal at a directional antenna and possible interfering signals at a separate omnidirectional antenna. The derived interfering signals are then used to cancel interference in the desired signal using various circuitry configurations. In this regard see, for example, U.S. Pat. Nos. 3,094,695 issued to D. M. Jahn on June 18, 1963 and 3,202,990 issued to P. W. Howells on Aug. 24, 1965.

Alternatively, for transmission purposes U.S. Pat. No. 3,704,464 issued to C. J. Drane, Jr. et al on Nov. 28, 1972 discloses a method for maximizing aerial directive gain while simultaneously placing nulls in the far-field radiation pattern of an array of N elements which are arbitrarily positioned. The patented method permits specification of directions of up to N−1 independent pattern nulls and/or sidelobes while assertedly providing maximum gain in some prescribed direction. This control is apparently achieved by varying only the amplitude and phase of the element currents in association with a standard gain formula.

U.S. Pat. No. 3,815,140 issued to W. E. Buehler et al on June 4, 1974 relates to a multiple feed arrangement for microwave parabolic antennas which include a parabolic reflector, and a plurality of individually fed illuminators. Each illuminator alone produces a beam of certain dimensions, and by combining the beams through the use of a predetermined configuration of illuminators, the physical configuration of the beam, including sidelobes, may be accurately controlled. Furthermore, certain illuminators may be fed by different information sources, thus resulting in a multiple information beam pattern.

Sidelobe suppression in directional antennas is usually accomplished by combining the signal from the main antenna with that of an auxiliary antenna, suitably adjusted in amplitude and phase. Since the auxiliary antenna is usually much smaller than the main antenna, their radiation patterns do not match. The result is that sidelobe suppression will be effective only over a narrow frequency band and angular sector. By introducing special equalizing networks, sidelobe suppression can be obtained over an increased bandwidth.

The problem remaining in the prior art is to be able to provide antenna arrangements which produce low sidelobes in selected directions to provide minimal interference in certain links over a wide bandwidth using simple techniques and without the need for equalization networks.

SUMMARY OF THE INVENTION

The foregoing problem has been solved in accordance with the present invention which relates to antenna arrangements for suppressing selected sidelobes and, more particularly, to antenna arrangements comprising a main antenna including a main reflector and a feedhorn and sidelobe suppressing means comprising either (a) at least two auxiliary antennas each including a reflector having a predetermined aperture and a feedhorn for launching the same signal, with a proper level and phase, as the main antenna, the auxiliary antennas being disposed on opposite sides of the main antenna with spacings that approximately equal the edges of the aperture of the main antenna in the plane of the sidelobes to be suppressed, or (b) sections of the reflective surface of the main reflector of the main antenna which are displaced by a predetermined amount in a direction parallel to the boresight axis of the main antenna in the plane of the sidelobes to be suppressed.

It is an aspect of the present invention to provide selective sidelobe suppression which will be effective over a large relative bandwidth. More particularly, in the arrangement using two auxiliary antennas, proper spacing and the use of suitable apertures will produce a frequency response which is well matched to that of the main antenna and thereby avoids the need for equalization networks. The alternative use of displaced sections of the reflective surface of the main antenna reflector will also produce a similar result since such sections are equivalent to the addition of the two auxiliary antennas.

Other and further aspect of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
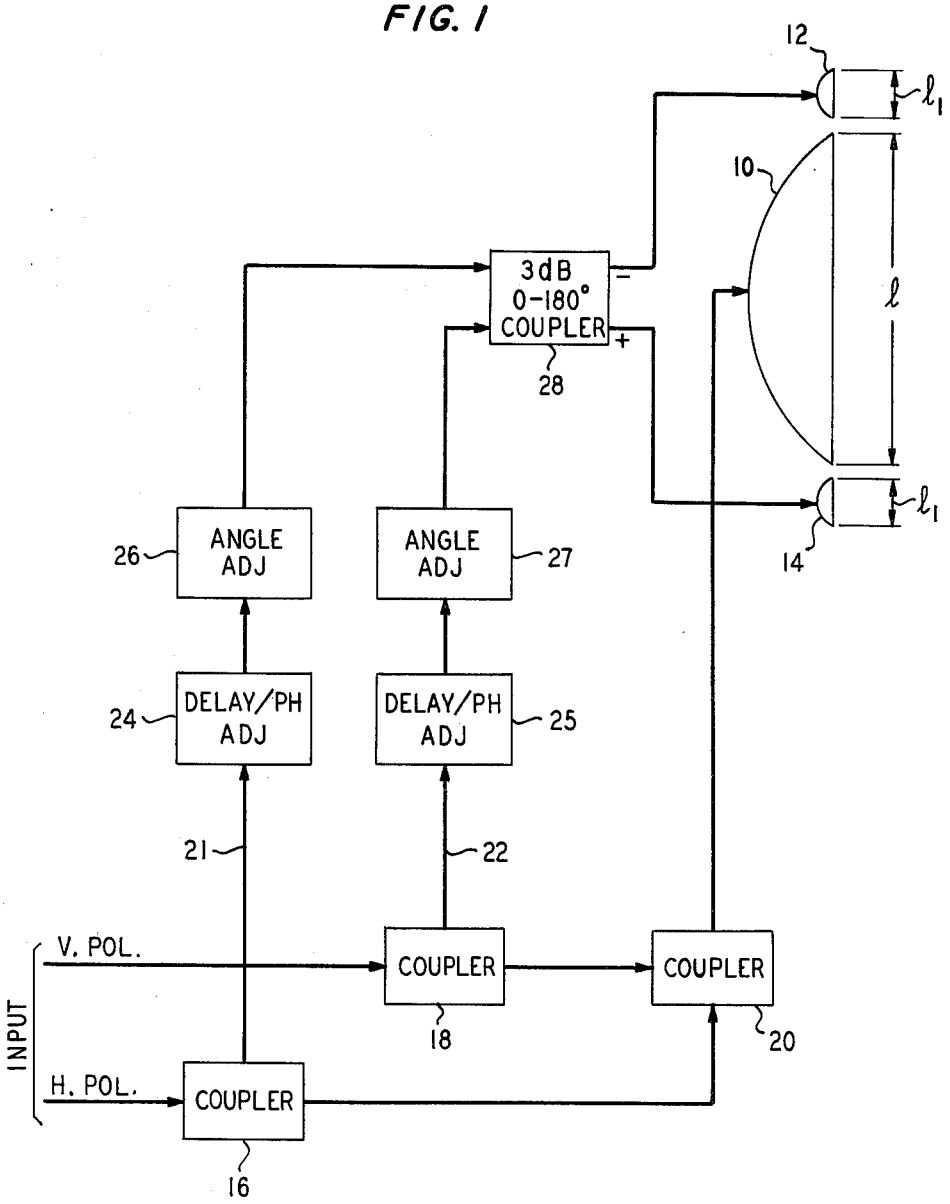
FIG. 1 illustrates an antenna arrangement in accordance with the present invention for providing wideband band sidelobe suppression in a selected plane.

FIG. 1 illustrates an antenna arrangement capable of launching a dual-polarized beam of electromagnetic energy toward a predetermined remote location while suppressing sidelobes of interest in selected directions. It is to be understood that the arrangement of FIG. 1 can also be applied for receiving similarly dual-polarized beams from remote locations since the various components to be described will also operate in a similar manner but in a reverse direction. A person skilled in the art, once understanding the components and operation of the arrangement of FIG. 1 or any other embodiment thereof, can easily remove the unnecessary components for, for example, transmitting or receiving a single-polarized signal.

In FIG. 1, a main antenna 10, comprising an aperture l, has a pair of identical spaced-apart smaller auxiliary antennas 12 and 14, each having an aperture $l_1$, disposed adjacent to and on symmetrically opposite sides of the main antenna 10 in the plane of the selected sidelobes to be suppressed. Preferably the spacing between the central rays of auxiliary antennas 12 and 14 should be as close as possible to the width of aperture l of main antenna 10 to achieve the best condition for sidelobe suppression as will become evident hereinafter.

A first and a second signal, which hereinafter will be referred to as horizontally and vertically polarized signals, respectively, are applied as inputs to a first and a second coupler 16 and 18, respectively, which function to pass most of the input signal energy to separate inputs of a coupler 20 and to direct a portion of the input signal energy to respective guides 21 and 22. It is to be understood that the first and second signal produces different field strength distributions in the aperture of main antenna 10. Whereas the first signal produces a uniform field strength distribution, the second signal produces a cosine tapered distribution. Such a difference can, for example, be obtained by using different polarizations for the two signals. Coupler 20 operates to combine the two input signals from couplers 16 and 18 and transmits the resultant combined signal to main antenna 10 for transmission to a remote location.

Concurrent therewith, the input signals directed into guides 21 and 22 are passed through separate delay and phase adjustment circuits 24 and 25, respectively, and then through separate respective angle adjust circuits 26 and 27, before being applied to separate inputs of a 3 dB, 0 or 180 degree, coupler 28. Coupler 28 functions to subtract the signals from angle adjust circuits 26 and 27 and deliver this resultant signal to auxiliary antenna 12 while concurrently adding the two input signals and delivering the resultant signal to auxiliary antenna 14. The signal which uniformly illuminates main antenna 10 is applied in opposite phase to auxiliary antennas 12 and 14, while the signal with cosine illumination of main antenna 10 is applied in phase to both antennas 12 and 14. As a result, the signal samples present at an instant in time at the input are divided in couplers 16 and 18 and processed in circuits 24–27 and coupler 28 so that these various portions of those signal samples are concurrently transmitted by antennas 10, 12 and 14 with the proper phase, level and angle to achieve sidelobe suppression.

Sidelobe suppression is obtained with the arrangement of FIG. 1 without the use of equalizing networks, provided the spacing of the auxiliary antennas as nearly as possible equals the aperture l of the main antenna 10 and the aperture $l_1$ of the auxiliary antennas 12 and 14 is properly chosen. It is known that given the aperture l of the main antenna, its radiation pattern will depend on the field strength distribution. In the case of certain horn antennas, this distribution is either uniform or cosine tapered. These two cases will be considered separately.

Figure 2:
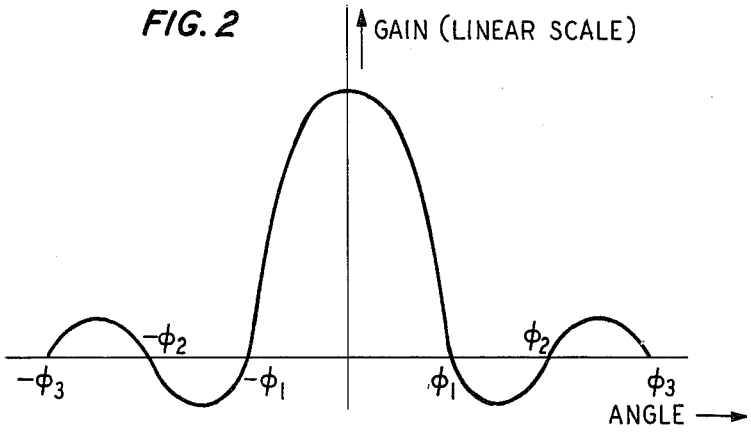
FIG. 2 illustrates a typical known antenna pattern formed by the main antenna of FIG. 1.

FIG. 2 shows a typical main antenna pattern, where gain is shown on a linear scale. At any given frequency, the sidelobe zeroes are equally spaced, i.e., $\phi_2-\phi_1=\phi_3-\phi_2= \ldots =\Delta$. To obtain the desired match, the pattern of the auxiliary antennas 12 and 14 shown by a dashed line in FIG. 3 should have the same periodicity as the solid line curve in FIG. 3 for the main antenna. To achieve such condition, a pair of auxiliary antennas with a spacing essentially equal to the aperture of the main antenna are required.

Figure 3:
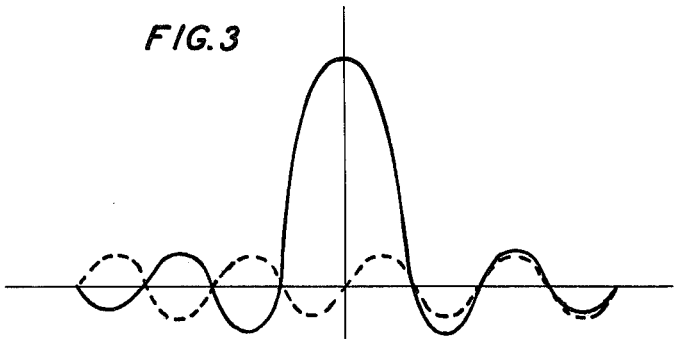
FIG. 3 illustrates a main antenna and an auxiliary antenna pattern with uniform illumination.
Figure 4:
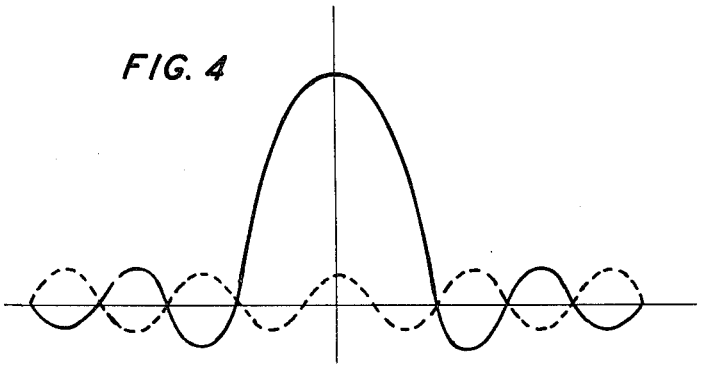
FIG. 4 illustrates a main antenna and an auxiliary antenna pattern with cosine illumination.

The width of the main lobe of main antenna 10 depends upon its illumination. The angle between its zeroes is $2\Delta$ in the case of uniform illumination and $3\Delta$ in the case of cosine illumination. This difference affects the required auxiliary pattern. In FIG. 3 the auxiliary antenna pattern is matched to the right hand sidelobes of a uniformly illuminated main antenna 10. It is to be noted that there exists a sign difference for the left hand sidelobes. The result will be that when a sidelobe on one side of the main lobe is cancelled, the corresponding sidelobe in the other side will be enhanced. This is not the case for cosine illumination, shown in FIG. 4. Because of the even symmetry of the auxiliary antenna pattern, shown by the dashed lines, required in this case, corresponding sidelobes on both sides of the boresight will be suppressed simultaneously.

The radiation pattern of a main antenna 10 with uniform illumination over an aperture l, is given by $$E(\psi) = l\frac{\sin\left(\frac{\pi l}{\lambda}\sin\psi\right)}{\frac{\pi l}{\lambda}\sin\psi} \tag{1}$$

where $\lambda$=wavelength and $\psi$=angle from normal of antenna.

As shown in FIG. 1, the two identical auxiliary antennas 12 and 14, each with uniform distribution across aperture $l_1$, and spaced by a distance l, are both aligned with the main antenna 10, i.e., provide maximum gain for the desired signal. They are connected to a 3 dB, 180 degree coupler for the uniform distribution case. The signal amplitude at the difference port of the coupler will be $$e(\psi) = \sqrt{2}\, l\sin\left(\frac{\pi l_1}{\lambda}\sin\psi\right)\frac{\sin\left(\frac{\pi l}{\lambda}\sin\psi\right)}{\frac{\pi l}{\lambda}\sin\psi} \tag{2}$$

When a sample $\alpha$ of $e(\psi)$ is subtracted from the main signal $E(\psi)$, the resulting difference signal is found by $$S(\psi)=E(\psi)-\alpha.e(\psi)=E(\psi).r(\psi) \quad (3)$$

where $r(\psi)$ is the sidelobe reduction factor and can be expressed as:

$$r(\psi) = 1 - \alpha\sqrt{2}\,\sin\left(\pi\frac{l_1}{\lambda}\sin\psi\right) \quad (4)$$

The value of $\alpha\sqrt{2}$ controls the depth of the minimum in the antenna pattern and $l_1$ controls its width and the values of the ratio $\sin\psi/\lambda$ at which this minimum occurs.

Figure 5:
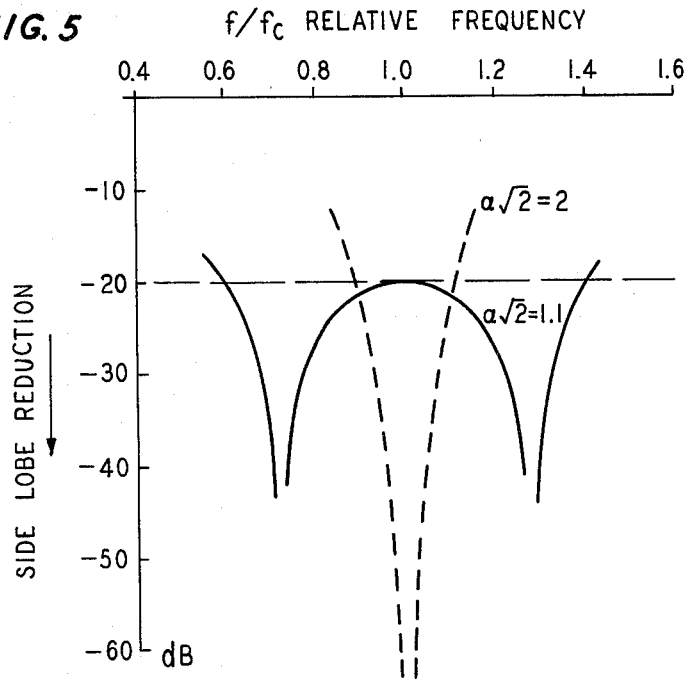
FIG. 5 illustrates curves for sidelobe reduction for uniform illumination of the main and auxiliary antennas of FIG. 1 for two values of $\alpha$.

FIG. 5 shows the dependence of sidelobe reduction on frequency. The value $\alpha\sqrt{2}=1.1$ will maximize the bandwidth over which 20 dB or more sidelobe suppression can be obtained. This bandwidth is approximately 78 percent as follows from FIG. 5.

Cancellation can be obtained with larger values of $\alpha$, resulting in smaller apertures of the auxiliary antennas. While these smaller apertures may be attractive, they are obtained at the cost of decreasing bandwidth and of progressively worsening sidelobe levels for other frequencies and angles. A possible compromise is the choice $\alpha\sqrt{2}=2$, which results in a 24 percent bandwidth and in sidelobe enhancement not exceeding 10 dB. The 20 dB cancellation bandwidth for large values of $\alpha$ can be found not to fall below 22 percent.

The term $r(\psi)$ is a periodic function of $$\pi\frac{l_1}{\lambda}$$

$\sin\psi$ with periodicity $2\pi$. This periodicity can be found to be reflected in the form of multiple zeroes in both frequency response and antenna pattern. This makes it possible to select values for $\alpha$ and $l_1$ which will produce sidelobe suppression at a number of frequencies and angles simultaneously.

Figure 6:
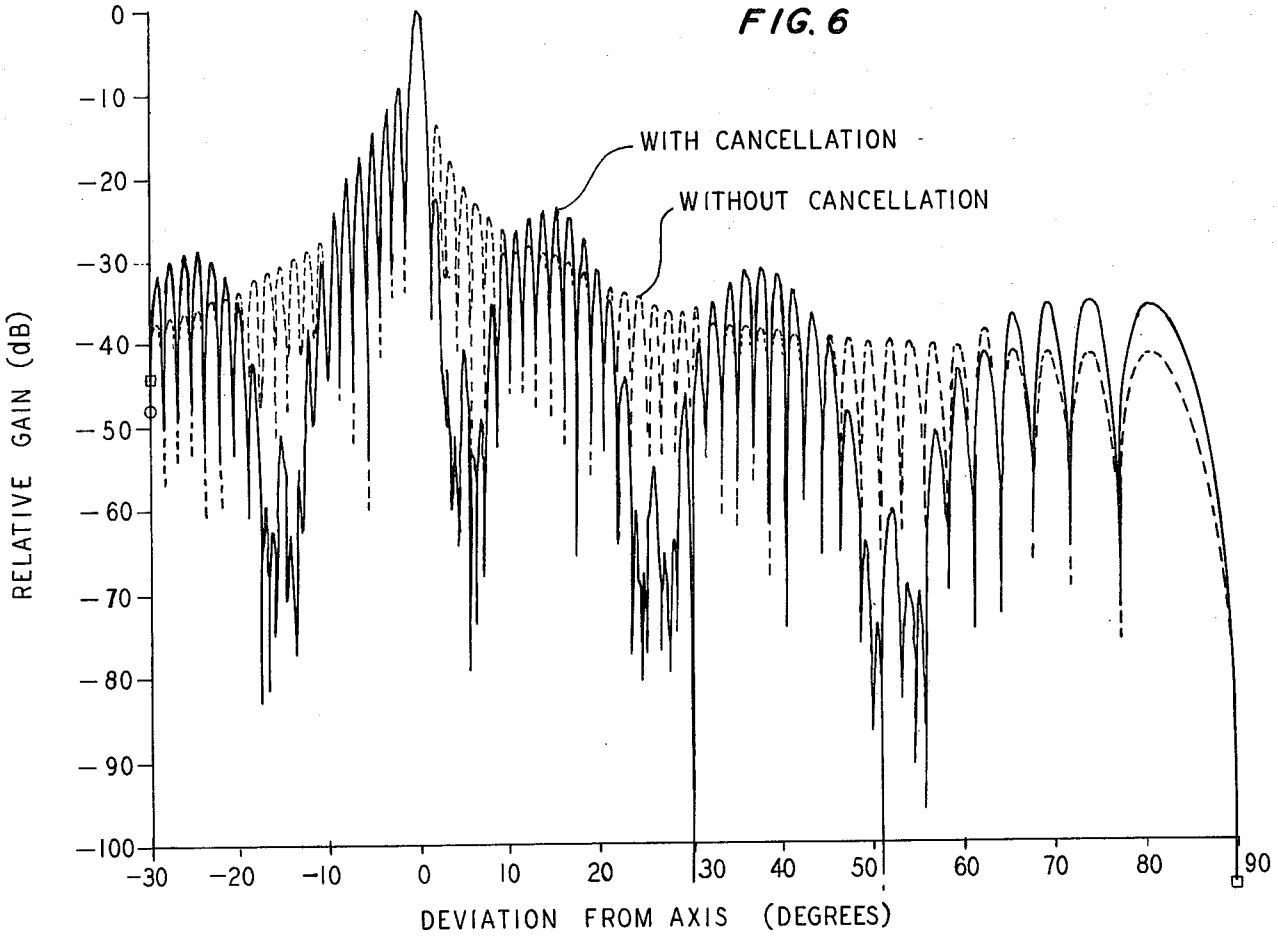
FIG. 6 illustrates an antenna pattern with and without sidelobe suppression using a 10 foot horn antenna and 17 inch auxiliary antennas at 4 GHz with uniform illumination in the arrangement of FIG. 1.

Since $r(\psi)$ does not have even symmetry around $\psi=0$, the modified antenna pattern will not be symmetrical. The antenna gain at $\psi=0$ is however not affected. FIG. 6 shows the antenna patterns for uniform distribution that can be expected from a 10 foot horn at 4 GHz without (dashed lines) and with (solid line) cancellation, using 17" auxiliary antennas. The antennas have been adjusted to produce 20 dB or more reduction over a 78 percent bandwidth at an angle $\psi_n=5$ degrees.

The periodic nature of the sidelobe suppression is evident in FIG. 6 as is the odd symmetry. Sidelobe suppression becomes enhancement when the angle is reversed. While the first order sidelobe on the right hand side of the boresight is reduced by 10 dB, the one on the left hand side is enhanced by 5 dB. 20 dB or more suppression can be expected between 3 degrees and 7 degrees on the right hand side of the normal. If instead of subtracting, $e(\psi)$ is added to the main signal $E(\psi)$, the combined pattern will be imaged around the boresight and sidelobes will be reduced on the other side of the main lobe.

It is to be understood that the formulas used hereinbefore to express antenna patterns provide good approximations for small angles $\psi$, i.e., in the high gain section of the antenna pattern. The trapezoidal shape of the horn, surface imperfections and the influence of higher order modes produce an actual pattern which deviates increasingly with increasing $\psi$ from that expressed by the formulas used here. The validity of such analysis is therefore limited to the high gain sector of the antenna encompassing the main lobe and the first few sidelobes.

With cosine illumination of the aperture l of the main antenna, its radiation pattern will be:

$$E(\psi) = \frac{2}{\pi}\,l\,\frac{\cos\left(\pi\frac{l}{\lambda}\sin\psi\right)}{1-\left(2\frac{l}{\lambda}\sin\psi\right)^2} \quad (5)$$

To the signal from this main antenna 10 will now be added a sample of the sum of two auxiliary antennas 12 and 14, properly adjusted in phase and amplitude using the arrangement shown in FIG. 1. Both auxiliary antennas 12 and 14 are aligned with main antenna 10, are identical, have aperture widths $l_1$, cosine illumination and their spacing equals the aperture l of main antenna 10.

The introduction of these auxiliary antennas modified the antenna pattern of equation (5) into a new pattern:

$$S(\psi)=E(\psi)xr(\psi) \quad (6)$$

where $r(\psi)$ is the sidelobe reduction factor and can be expressed as:

$$r(\psi) = 1 - k\,\frac{\left(\frac{l_1}{\lambda}\sin\psi\right)^2}{1-\left(\frac{2l_1}{\lambda}\sin\psi\right)^2}\cos\left(\pi\frac{l_1}{\lambda}\sin\psi\right) \quad (7)$$

where $$k = 4\alpha\sqrt{2}\,\frac{l_1}{l}.$$

The value of the parameter k controls the depth and the width of the minimum in the antenna pattern. Choosing $k=3.198$, for example, will maximize the bandwidth for 20 dB suppression, which bandwidth is found to be 56 percent.

Figure 7:
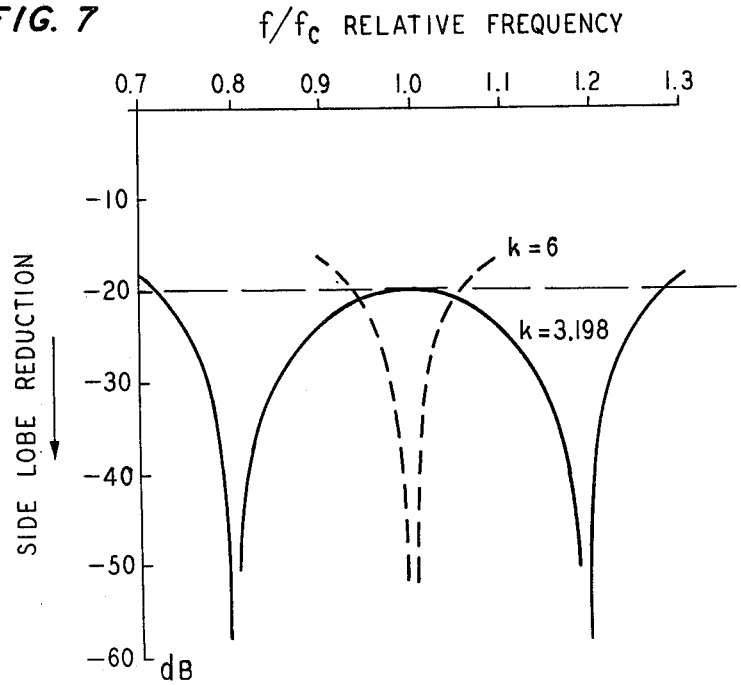
FIG. 7 illustrates curves for sidelobe suppression for cosine illumination of the main and auxiliary antennas of FIG. 1 for two values of k.

As in the case of uniform illumination, increasing $\alpha$ will make it possible to use auxiliary antennas 12 and 14 with smaller apertures. The price paid for this saving is here too one of the progressive worsening sidelobe levels at other frequencies and angles. The largest value of k (i.e., the smallest aperture $l_1$) that will assure 20 dB suppression over the 4 GHz band (3.7–4.2 GHz) can be found to be $k=6$. FIG. 7 shows the sidelobe reduction for both values of k as a function of frequency.

For large values of $l_1/\lambda\sin\psi$, equation (7) simplifies to $$r(\psi) = 1 + \frac{k}{4}\cos\left(\pi\frac{l_1}{\lambda}\sin\psi\right)$$

and becomes periodic with $\pi \frac{l_1}{\lambda}$ sin $\psi$. The result of this is here too the appearance of multiple zeroes in both frequency response and antenna pattern and the possibility of producing sidelobe suppression at a number of frequencies and angles simultaneously. It can be seen that $r(\psi)$ has even symmetry around $\psi=0$.

Figure 8:
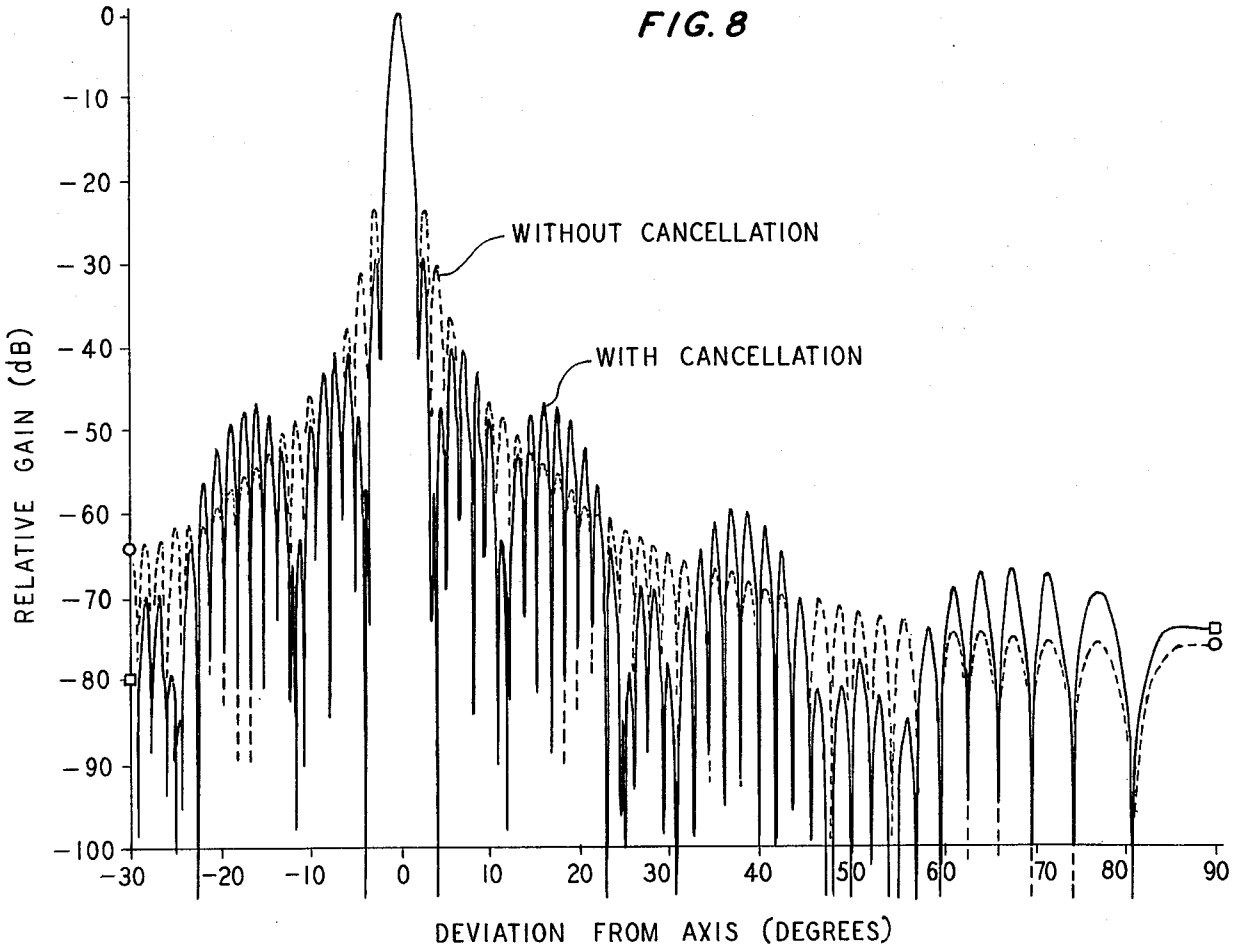
FIG. 8 illustrates an antenna pattern with and without sidelobe suppression at 4 GHz using a 10 foot horn antenna and 19 inch auxiliary antennas with cosine illumination in the arrangement of FIG. 1.

The worst combination of frequency and angle will be seen to increase sidelobe levels by a factor approaching $(1+k/4)$ for large values of $l_1/\lambda \sin \psi$. At $k=6$ this will mean an 8 dB increase. FIG. 8 shows typical antenna patterns with (solid line) and without (dashed line) cancellation using 19.5" auxiliary antennas 12 and 14, a main antenna having a 10 foot aperture, and a frequency of 4 GHz. The auxiliary antennas have been adjusted to produce 20 dB or more reduction across the 4 GHz microwave band at an angle $\psi_n=4$ degrees. First order sidelobe levels in the symmetrical pattern are reduced from −23 dB to −30 dB. The periodicity of the suppression with angle is evident, as is the 8 dB enhancement of sidelobe levels at unfavorable angles.

In an alternative embodiment of the present invention, instead of relying on external auxiliary antennas 12 and 14 to supply correction signals of the right level and phase, sidelobe suppression can be obtained in some cases by modifying propagation conditions for strategically located areas within the main antenna 10. For example, by displacing sections of the reflecting surface, the path length for a fraction of the received signal can be changed. Level and phase of this signal fraction depend on the area and the displacement of the reflector section. In calculating the effect of this change it should be remembered to subtract the contribution made by the displaced section in its original position.

Figure 9:
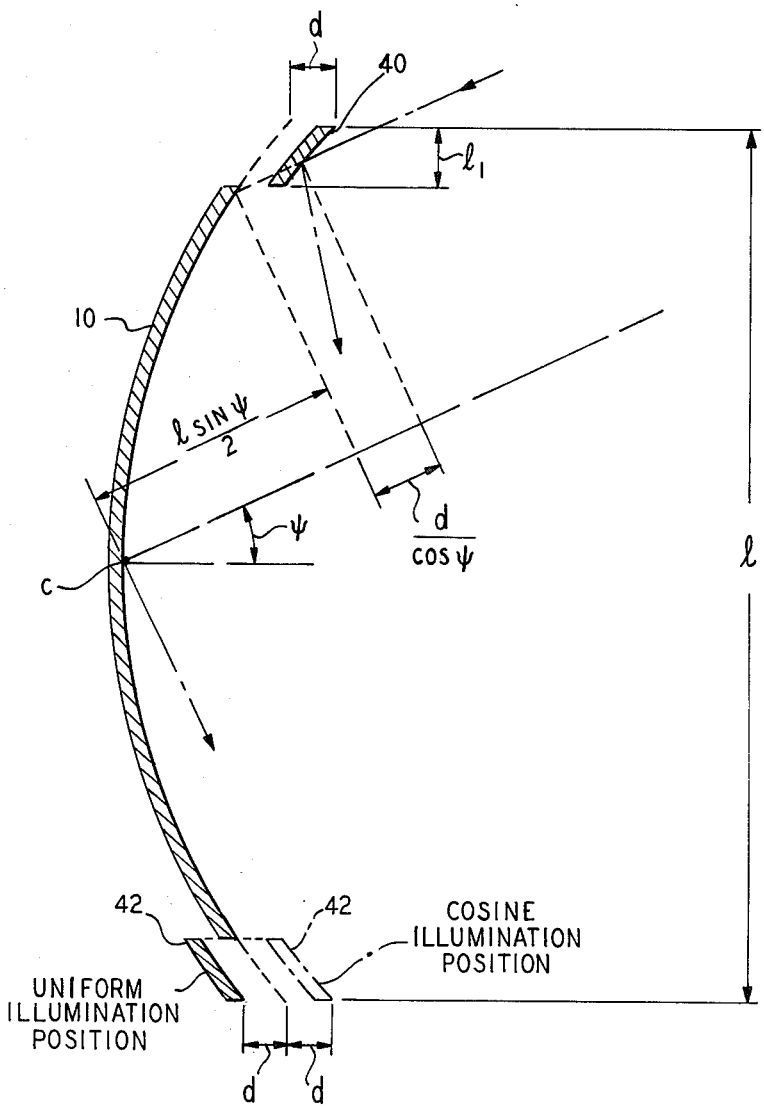
FIG. 9 illustrates an antenna arrangement in accordance with the present invention for providing wideband sidelobe suppression in a selected plane where sections of the main antenna are displaced.

The equivalent of two auxiliary antennas 12 and 14 can therefore be obtained by displacing two sections of the reflecting surface, provided the distance between them equals that between the auxiliary antennas and their areas and displacements are properly chosen. FIG. 9 illustrates a typical arrangement for main reflector 10 to provide sidelobe suppression in accordance with the present invention by the displacement of section 40 and 42 on opposite edges of reflector 10 as will be described hereinafter for uniform or cosine illumination conditions. In FIG. 9 each section 40 and 42 is displaced by an amount d in the boresight direction dependent on the type of illumination and in the plane of the sidelobes to be suppressed.

If $M(\psi)$ is the radiation pattern of a single displaced reflector section, e.g., section 40, where $\psi$ is the angle from boresight of rays impinging reflector 10, then the contribution of one displaced reflector section to the received signal will be $$\overline{m} = M(\psi) \cdot e^{-j\omega\left(\frac{l\sin\psi}{2v} + \frac{d}{v\cos\psi}\right)} \tag{8}$$

where $\cap$ = angular frequency, l = distance between displaced sections (l ≈ antenna aperture), and v = propagation velocity.

The contribution from a second reflector section, e.g., section 42, symmetrically located with respect to the center of reflector 10, displaced by distance d in the opposite direction and having the same radiation pattern $M(\psi)$, will be $$\overline{n} = M(\psi) \cdot e^{j\omega\left(\frac{l\sin\psi}{2v} + \frac{d}{v\cos\psi}\right)}. \tag{9}$$

Together the two sections 40 and 42 contribute $$\overline{m} + \overline{n} = 2M(\psi) \cdot \cos\left(\frac{\omega l\sin\psi}{2v} + \frac{\omega d}{v\cos\psi}\right) = 2M(\psi)\cos\left(\frac{\pi l\sin\psi}{\lambda} + \frac{2\pi d}{\lambda\cos\psi}\right). \tag{10}$$

Since, by displacing the two reflector sections 40 and 42, the contribution $\overline{m}'+\overline{n}'$ made by these sections in their original position (d=0) will be lost, where $$\overline{m}' + \overline{n}' = 2M(\psi)\cos\left(\frac{\pi l\sin\psi}{\lambda}\right) \tag{11}$$

and this contribution will have to be subtracted to find the change in the original antenna pattern. Displacing the two reflector sections 40 and 42 is found to be equivalent to adding auxiliary antennas 12 and 14 with a pattern $$e(\psi) = \overline{m} + \overline{n} - \overline{m}' - \overline{n}' = -4M(\psi)\sin\left(\frac{\pi d}{\lambda\cos\psi}\right) \cdot \sin\left(\frac{\pi l\sin\psi}{\lambda} + \frac{\pi d}{\lambda\cos\psi}\right). \tag{12}$$

For directions near boresight, where $\cos\psi \approx 1$ and for small displacements, where $d << \lambda/2$, it can be assumed that $$\sin\left(\frac{\pi d}{\lambda\cos\psi}\right) \approx \frac{\pi d}{\lambda\cos\psi} \approx \frac{\pi d}{\lambda} \text{ and}$$

$$\sin\left(\frac{\pi l\sin\psi}{\lambda} + \frac{\pi d}{\lambda\cos\psi}\right) \approx \sin\left(\frac{\pi l\sin\psi}{\lambda}\right).$$

Assuming uniform illumination of the displaced sections 40 and 42, which have an aperture $l_1$, it is found that $$e(\psi) = -4\pi\frac{d}{\lambda} l_1 \frac{\sin\left(\frac{\pi l_1}{\lambda}\sin\psi\right)}{\frac{\pi l_1}{\lambda}\sin\psi} \cdot \sin\left(\frac{\pi l}{\lambda}\sin\psi\right). \tag{13}$$

Assuming uniform illumination of the antenna, its original pattern was shown in equation (1) and its modified pattern in equation (3). The sidelobe reduction factor is therefore:

$$r(\psi) = 1 + \frac{e(\psi)}{E(\psi)} = 1 - 4\pi\frac{d}{\lambda}\sin\left(\frac{\pi l_1}{\lambda}\sin\psi\right). \tag{14}$$

The sidelobe reduction factor obtained with two auxiliary antennas and uniform illumination was shown in equation (4) and it is obvious that similar results can be obtained if instead of varying $\alpha$ the displacement d is varied.

The radiation pattern of an antenna with aperture l and cosine illumination was shown in equation (5). To modify this pattern and obtain sidelobe suppression at specified angles, the two symmetrical sections 40 and 42 of the reflector 10 will be displaced in the same direction, parallel to the boresight axis, as shown in FIG. 9 compared to opposite displacement direction parallel to the boresight axis when modifying reflector 10 for uniform illumination.

If both sections 40 and 42 are displaced by a distance d in the appropriate boresight direction, their contributions to the received signal are found to be $$\overline{m} = M(\psi)\cdot e^{j\omega\left(\frac{-d}{v\cos\psi} - \frac{l\sin\psi}{2v}\right)} \tag{15}$$

$$\overline{n} = M(\psi)\cdot e^{j\omega\left(\frac{-d}{v\cos\psi} + \frac{l\sin\psi}{2v}\right)} \tag{16}$$

Together their contribution is $$\overline{m} + \overline{n} = 2M(\psi)\cos\left(\frac{\omega l\sin\psi}{2v}\right)\cdot e^{-j\frac{\omega d}{v\cos\psi}} \text{ or:} \tag{17}$$

$$\overline{m} + \overline{n} = 2M(\psi)\cos\left(\frac{\omega l\sin\psi}{\lambda}\right)\cdot e^{-j\frac{2\pi d}{\lambda\cos\psi}}.$$

To find the change in the antenna pattern caused by this reflector displacement, the contribution made by these displaced sections in their original position (d=0), must be subtracted, which is $$\overline{m'} + \overline{n'} = 2M(\psi)\cos\left(\frac{\pi l\sin\psi}{\lambda}\right). \tag{18}$$

It follows that displacing the two reflector sections 40 and 42 is equivalent to adding auxiliary antennas 12 and 14 with a radiation pattern $$e(\psi) = \overline{m} + \overline{n} - \overline{m'} - \overline{n'} = -4M(\psi)\cdot\sin\left(\frac{\pi d}{\lambda\cos\psi}\right)\cdot \cos\left(\frac{\pi l\sin\psi}{\lambda}\right)\cdot e^{-j\frac{\pi d}{\lambda\cos\psi}}. \tag{19}$$

For small angles $\psi$, where $\cos\psi \approx 1$ and for small displacements d, where $d/\lambda << \frac{1}{2}$, this can be simplified to $$e(\psi) = -4M(\psi)\cdot\pi\frac{d}{\lambda}\cdot\cos\left(\frac{\pi l\sin\psi}{\lambda}\right). \tag{20}$$

Since it is to be expected that the displaced reflector sections are small, it will be assumed that their illumination is uniform over their aperture $l_1$ and their radiation pattern therefore is $$M(\psi) = l_1\frac{\sin\left(\frac{\pi l_1}{\lambda}\sin\psi\right)}{\frac{\pi l_1}{\lambda}\sin\psi}. \tag{21}$$

Displacing the two reflector sections 40 and 42 is therefore equivalent to using auxiliary antennas 12 and 14 with a radiation pattern $$e(\psi) = 4\pi\frac{d}{\lambda}l_1\frac{\sin\left(\frac{\pi l_1}{\lambda}\sin\psi\right)}{\frac{\pi l_1}{\lambda}\sin\psi}\cdot\cos\left(\frac{\pi l}{\lambda}\sin\psi\right). \tag{22}$$

The original antenna pattern produced with cosine illumination was shown by equation (5) and its modified pattern was shown by equation (6). The sidelobe reduction factor $r(\psi)$ is therefore:

$$r(\psi) = 1 + \frac{e(\psi)}{E(\psi)} = 1 + 4\frac{d}{\lambda}l_1\frac{\sin\left(\frac{\pi l_1}{\lambda}\sin\psi\right)}{\frac{\pi l_1}{\lambda}\sin\psi}\cdot\frac{1-\left(2\frac{l}{\lambda}\sin\psi\right)^2}{\frac{2}{\pi}l}. \tag{23}$$

If it is assumed that at operating frequencies and angles $\psi$ are $$\left(\frac{2l}{\lambda}\sin\psi\right)^2 >> 1,$$

then equation (23) can be simplified to $$r(\psi) = 1 - 8\frac{d}{\lambda}\frac{l}{l_1}\left(\frac{\pi l_1}{\lambda}\sin\psi\right)\cdot\sin\left(\frac{\pi l_1}{\lambda}\sin\psi\right). \tag{24}$$

Similar to the expression found hereinbefore for the sidelobe suppression factor when the antenna illumination is cosine distributed, the expression (24), as a function of $\psi$, has even symmetry around $\psi=0$. The first minimum of $r(\psi)$ occurs when $l_1/\lambda \sin\psi = \pm 0.645$ and at this minimum the sidelobe reduction factor is $r(\psi) = 1 - 14.5\, d/\lambda\, l/l_1$.

Here it will be possible to adjust the angle $\psi$ and the bandwidth of the suppressed sidelobe by an appropriate choice of the aperture $l_1$ and the displacement d.

I claim:

1. An antenna arrangement capable of suppressing selected sidelobes, the antenna arrangement comprising:

a main antenna (10) comprising a main focusing reflector including a predetermined aperture (l) and a feed arrangement disposed to radiate a first beam of electromagnetic energy when emitted therefrom along a feed axis of the main antenna for reflection by the main focusing reflector toward the aperture thereof with a predetermined amplitude distribution thereacross characterized in that the antenna arrangement further comprises:

first and second suppression means (12, 14, 40 and 42) disposed adjacent to and on symmetrically opposite sides of the main focusing reflector in the plane of the sidelobes to be suppressed with a distance therebetween that approximates the width of the aperture of the main focusing reflector, the first and second suppression means being capable of directing second and third beams, respectively, of electromagnetic energy in the direction of the first beam with a radiation pattern which comprises an amplitude and periodicity which corresponds to, and a phase opposite to, the selected sidelobes to be suppressed.

2. An antenna arrangement according to claim 1 characterized in that the first and second suppression means comprises a first and a second auxiliary antenna (10, 12), respectively, each auxiliary antenna comprising a focusing reflector including a predetermined aperture ($l_1$) which is smaller than the aperture of the main focusing reflector, and a feed arrangement capable of providing a predetermined amplitude distribution across the aperture thereof.

3. An antenna arrangement according to claim 2 characterized in that the antenna arrangement further comprises:

coupling means (16 or 18) disposed in an input transmission element to the feed arrangement of the main antenna capable of coupling a predetermined portion of a signal propagating in said transmission element for delivery to the first and second auxiliary antennas; and means (24, 26 or 25, 27 and 28) coupled between said coupling means and the first and second auxiliary antennas capable of introducing a predetermined phase relationship between a first and a second signal being delivered to the first and the second auxiliary antennas, respectively, which phase relationship is dependent on the predetermined amplitude distribution being provided across the apertures of the main and auxiliary antennas.

4. An antenna arrangement according to claim 3 characterized in that in response to a uniform amplitude distribution being applied across the aperture of the main and first and second auxiliary antennas, said phase relationship introducing means introduces a 180 degree phase difference between the signals applied to the first and second auxiliary antennas.

5. An antenna arrangement according to claim 3 characterized in that in response to a cosine amplitude distribution being applied across the apertures of the main and first and second auxiliary antennas, said phase relationship introducing means maintains the same phase relationship between the signals applied to the first and second auxiliary antennas.

6. An antenna arrangement according to claim 1 characterized in that the first and second suppression means comprise a first and a second section (40, 42) of the main focusing reflector, respectively, symmetrically located and including opposite edges of each main focusing reflector, each section including a predetermined aperture ($l_1$) and being displaced by a predetermined distance (d) from the extension of the reflecting surface of said main focusing reflector in a predetermined separate direction parallel to a boresight axis of the main antenna for directly intercepting a portion of the first beam radiated by the feed arrangement of the main antenna and forming said second and third beams, respectively, said direction of displacement for each section being dependent on the predetermined amplitude distribution being applied across the aperture of the main antenna.

7. An antenna arrangement according to claim 6 characterized in that in response to a uniform amplitude distribution being applied across the aperture of the main antenna, said first and second sections of the main focusing reflector are displaced in opposite directions by said predetermined distance.

8. An antenna arrangement according to claim 6 characterized in that in response to a cosine amplitude distribution being applied across the aperture of the main antenna, said first and second sections of the main focusing reflector are displaced in the same direction by said predetermined distance.

* * * * *